US010986902B2

(12) United States Patent
Loetscher

(10) Patent No.: US 10,986,902 B2
(45) Date of Patent: Apr. 27, 2021

(54) TIMEPIECE OR PIECE OF JEWELLERY

(71) Applicant: Omega SA, Biel/Bienne (CH)

(72) Inventor: Philippe Loetscher, Evilard (CH)

(73) Assignee: Omega SA, Biel/Bienne (CH)

( * ) Notice: Subject to any disclaimer, the term of this patent is extended or adjusted under 35 U.S.C. 154(b) by 85 days.

(21) Appl. No.: 16/433,137

(22) Filed: Jun. 6, 2019

(65) Prior Publication Data

US 2020/0015555 A1 Jan. 16, 2020

(30) Foreign Application Priority Data

Jul. 16, 2018 (EP) ..... 18183689

(51) Int. Cl.
*A44C 5/14* (2006.01)
*A44C 5/20* (2006.01)

(52) U.S. Cl.
CPC ..... *A44C 5/2019* (2013.01); *A44C 5/145* (2013.01)

(58) Field of Classification Search
CPC ..... A44C 5/14; A44C 5/142; A44C 5/145; A44C 5/16; A44C 5/0053; A44C 5/147; A44C 5/2047; A44C 5/2033; A44C 5/2038; Y10T 24/4782; Y10T 24/4718; Y10T 24/45414; Y10T 24/45408; Y10T 24/4523; Y10T 24/45267; Y10T 24/45262; Y10T 24/45288; Y10T 24/4755; Y10T 24/3429; Y10T 24/3449; Y10S 24/906; G04B 37/16; G04B 37/1486; G04B 37/1413; G04B 37/1446; F16B 7/22; F16B 45/00
USPC ..... 224/167, 180; 403/375
See application file for complete search history.

(56) References Cited

U.S. PATENT DOCUMENTS 1,050,221 A * 1/1913 Matalene ..... A44C 5/14 24/265 WS
1,447,718 A * 3/1923 Gruen ..... G04B 37/1486 24/265 R
1,457,432 A 6/1923 Guyot et al.
1,532,613 A 4/1925 Valcourt
1,575,622 A * 3/1926 Coffey ..... A44C 5/145 24/601.1
1,583,816 A * 5/1926 Valcourt ..... A44C 5/145 24/328

(Continued)

FOREIGN PATENT DOCUMENTS

FR 1 160 911 8/1958
FR 2 744 538 A1 8/1997

OTHER PUBLICATIONS

European Search Report dated Jan. 18, 2019 in European Application 18183689.1, filed on Jul. 16, 2018 (with English Translation of Categories of Cited Documents).

(Continued)

*Primary Examiner* — Jack W Lavinder
(74) *Attorney, Agent, or Firm* — Oblon, McClelland, Maier & Neustadt, L.L.P.

(57) ABSTRACT

A timepiece or piece of jewelry includes a structure with a set of horns carrying a bar receiving a removable snap-hook fixed to a strand. The bar includes, at a distance from each of the points of attachment to the set of horns, a notch including two sides which limit the lateral travel of a curved beak portion of the snap-hook and limit the angular travel of the snap-hook with respect to the bar, so as to prevent any contact between the snap-hook and the set of horns to which the bar is fixed.

19 Claims, 3 Drawing Sheets

(56) References Cited

U.S. PATENT DOCUMENTS

| | | | | | |
|---|---|---|---|---|---|
| 1,611,863 | A * | 12/1926 | Hadley | A44C 5/145 | 24/265 R |
| 1,765,966 | A * | 6/1930 | Clark | A44C 5/14 | 224/177 |
| 2,157,288 | A * | 5/1939 | Gauss | A44C 5/14 | 24/600.7 |
| 2,850,783 | A * | 9/1958 | Megar | A44C 5/145 | 24/265 WS |
| 2,876,521 | A | 3/1959 | Legman | | |
| 8,701,438 | B1 * | 4/2014 | Kovel | A44C 9/00 | 63/3.1 |

OTHER PUBLICATIONS

Combined Chinese Office Action and Search Report dated Nov. 2, 2020 in Patent Application No. 201910635795.6 (with English translation of Categories of Cited Documents), 7 pages.

Notice of the Reason for Refusal dated Aug. 18, 2020 in Japanese Patent Application No. 2019-118230 (with English language translation), 2 pages.

* cited by examiner

TIMEPIECE OR PIECE OF JEWELLERY

CROSS-REFERENCE TO RELATED APPLICATION

The present application claims priority to European Patent Application No. 18183689.1, filed on Jul. 16, 2018, the entire content and disclosure of which are incorporated by reference herein.

FIELD OF THE INVENTION

The invention concerns a timepiece or piece of jewellery including a structure which includes at least one set of horns, and at least a first slender bar, which is fixed or removable with respect to first points of attachment to a first set of horns, said first bar is arranged to removably receive a karabiner-like snap-hook fixed to a first end of a first strand of said timepiece of piece of jewellery, said snap-hook including, on the one hand, a hook comprising a curved beak portion arranged to enclose said first bar on part of its circumference, and on the other a retaining latch which is elastic, or elastically secured to said hook and defines therewith an eyelet opening, and arranged to allow the insertion of said first bar into said eyelet of said snap-hook by means of pressure in a plane substantially perpendicular to the axis of said first bar, and to prevent the removal thereof from said snap-hook without user manipulation.

The invention concerns the field of safety fasteners and closures for portable timepieces such as watches, and for pieces of jewellery, which may, in both cases, be worn directly by the user, on the wrist for example, or worn on a piece of clothing or a particular device carried by the user.

BACKGROUND OF THE INVENTION

Securing a watch or a piece of jewellery to a bracelet or strap or to a piece of clothing requires precautions to ensure retention of the object, and to prevent the object being damaged by friction or scratching caused by the safety retention mechanism.

Interchangeable attachment of a watch or a jewel to a bracelet, or to a piece of clothing, creates additional constraints since the object must be easily removable, without compromising the safety or protection thereof.

SUMMARY OF THE INVENTION

The invention proposes to improve the protection of an object such as a watch or jewel with respect to its own means of retention, while ensuring foolproof security.

To this end, the invention concerns a timepiece or piece of jewellery according to claim 1.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
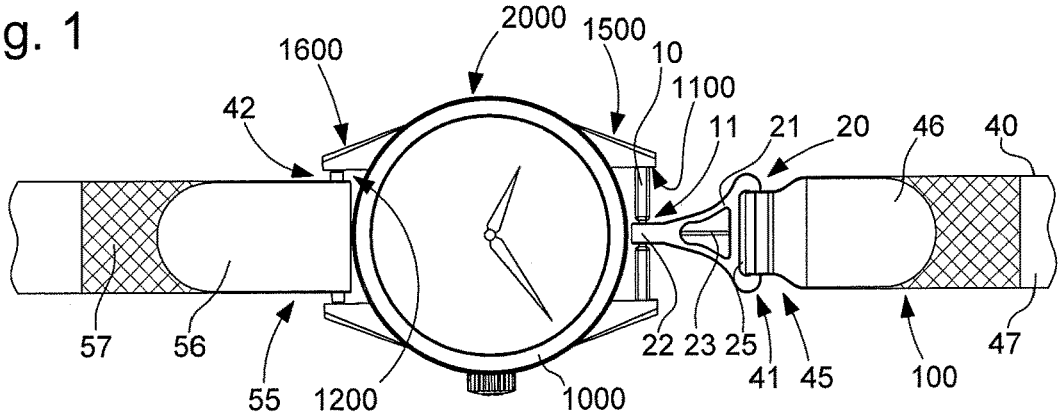
FIG. 1 represents, a schematic plan view of a timepiece according to the invention, a watch here, comprising a structure provided with sets of horns, each set bearing a bar, one of the bars including a substantially central notch receiving a curved beak portion of a karabiner-like snap-hook, which snap-hook carries a bracelet strand, said notch being arranged to limit the lateral and angular movement of the curved beak portion, the other bar carrying two superposed fastening strap pieces of a bracelet strand which are fixed to each other by "Velcro", as is the strand carried by the snap-hook.
Figure 2:
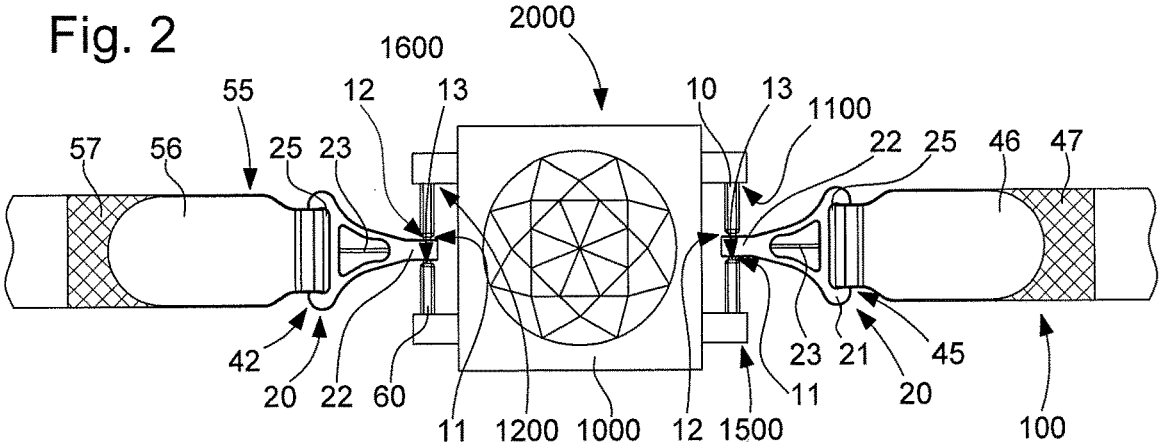
FIG. 2 represents, in a similar manner to FIG. 1, a piece of jewellery according to the invention, including, at each set of horns, one such bar with a notch for receiving a snap-hook.
Figure 3:
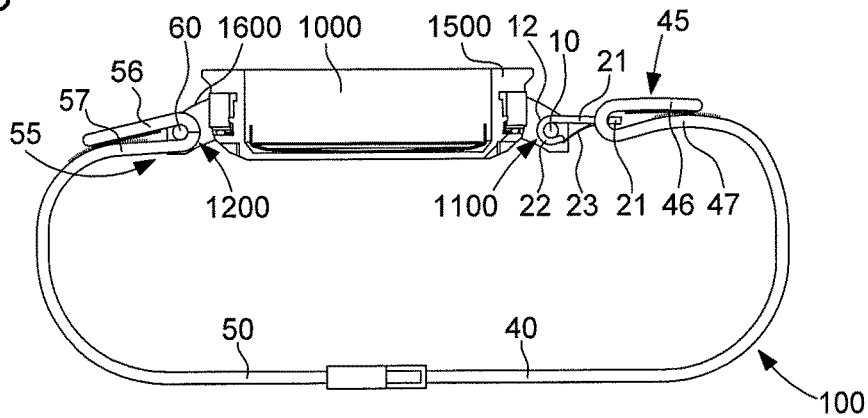
FIG. 3 represents a schematic longitudinal section of a variant of FIG. 1, with a bracelet comprising two strands assembled by a clasp or suchlike.
Figure 4:
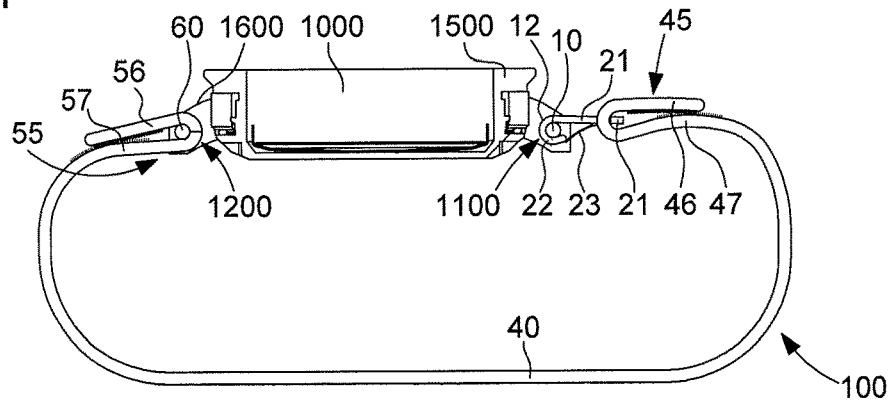
FIG. 4 represents, in a similar manner to FIG. 2, a variant of FIG. 1, with a bracelet having a single strand.

The invention concerns a timepiece or piece of jewellery 2000 comprising a structure 1000, such as a watch case, a jewellery case or suchlike.

This structure 1000 includes at least one set of horns 1500, 1600, and more particularly, as in the case of the variants illustrated by the Figures, two sets of horns 1500 and 1600 on either side of this structure.

Structure 1000 includes at least a first slender bar 10, which is fixed or removable with respect to first points of attachment 1100 to a first set of horns 1500. In the non limiting variant of the Figures, structure 1000 also includes at least a second slender bar 60, which is fixed or removable with respect to second points of attachment 1200 to a second set of horns 1600.

This first bar 10 is arranged to removably receive a karabiner-like snap-hook 20 fixed to a first end 41 of a first strand 40 comprised in the timepiece or piece of jewellery 2000. This snap-hook 20 includes, on the one hand a hook 21 comprising a curved beak portion 22 arranged to enclose first bar 10 on part of its circumference, and on the other hand, a retaining latch 23 which is elastic or elastically fixed to hook 21 and defines therewith an eyelet opening 24. Retaining latch 23 is arranged to allow the insertion of first bar 10 into eyelet 24 of snap-hook 20 by means of pressure in a plane substantially perpendicular to the axis of first bar 10, and to prevent the removal thereof from snap-hook 20 without user manipulation.

The triangular snap-hook 20 illustrated in the variants of the Figures has the same shape as the safety karabiners devised to be used on the moon in the Apollo missions on the safety ropes connecting the astronaut to the lunar module, some of which were left on lunar soil. More particularly, it is made of an alloy of titanium.

Figure 11:
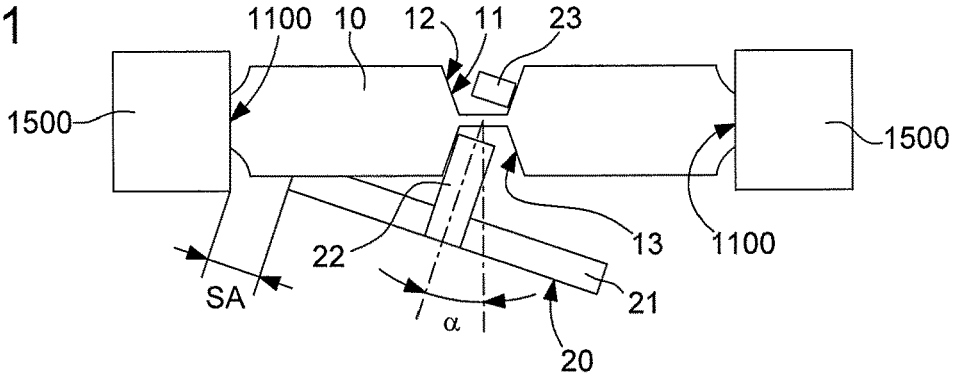
FIG. 11, which is similar to FIG. 9, illustrates another variant with a bar having a V-shaped notch, and the snap-hook curved beak portion curved beak portion, with the latter represented in an extreme warped position, limited by the cooperation between its curved beak portion and the notch of the bar, and showing a first safety distance between the horns and the snap-hook.
Figure 12:
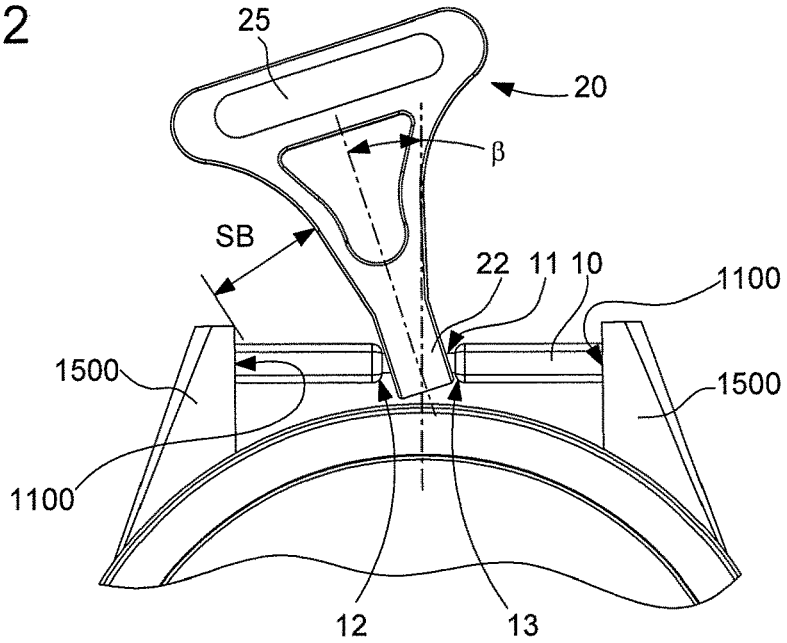
FIG. 12, which is similar to FIG. 8, illustrates the same timepiece or piece of jewellery with a bar whose notch has a straight profile, and the the snap-hook curved beak portion, with the latter represented in a position of maximum travel in the plane of the horns, limited by the cooperation between its latch and the notch of the bar, and showing a second safety distance between the horns and the snap-hook.

According to the invention, first bar 10 includes, at a distance from each of the first points of attachment 1100 to structure 1000, a notch 11, of width LG, having two sides 12, 13, which are arranged to limit the lateral travel of curved beak portion 22, and to limit the angular travel of snap-hook 20 with respect to first bar 10, so as to prevent any contact between snap-hook 20 and first set of horns 1500 to which the first bar 10 is attached, as seen in FIGS. 11 and 12.

More particularly, first strand 40 is a strand of a bracelet 100 comprised in the timepiece or piece of jewellery 2000.

Figure 5:
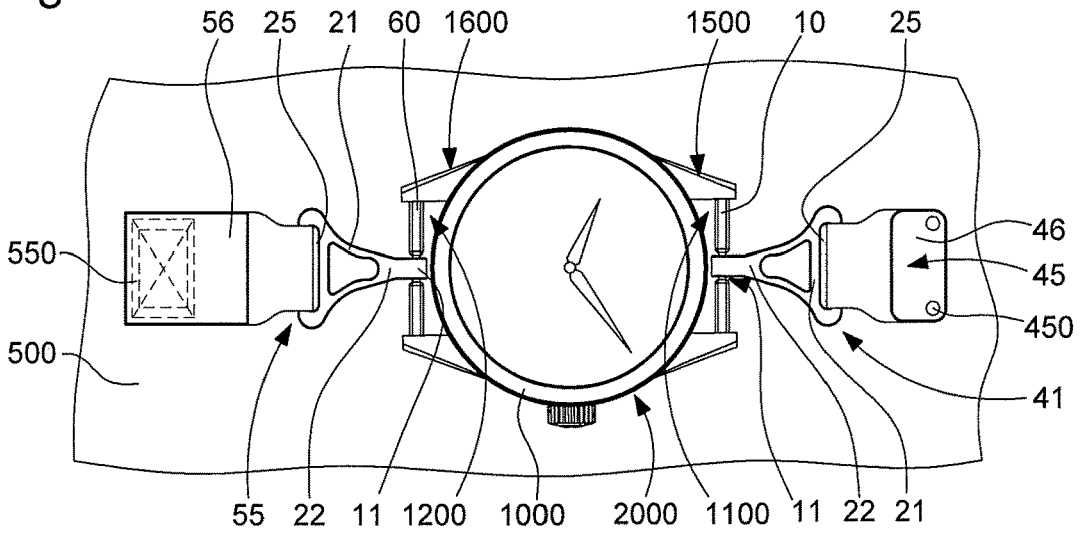
FIG. 5 represents, in a similar manner to FIG. 2, another timepiece or piece of jewellery including, at each set of horns, one such bar with a notch for receiving a snap-hook for the attachment thereof to a piece of clothing, wherein one strand is assembled by rivets or a snap fastener and the other is sewn.
Figure 6:
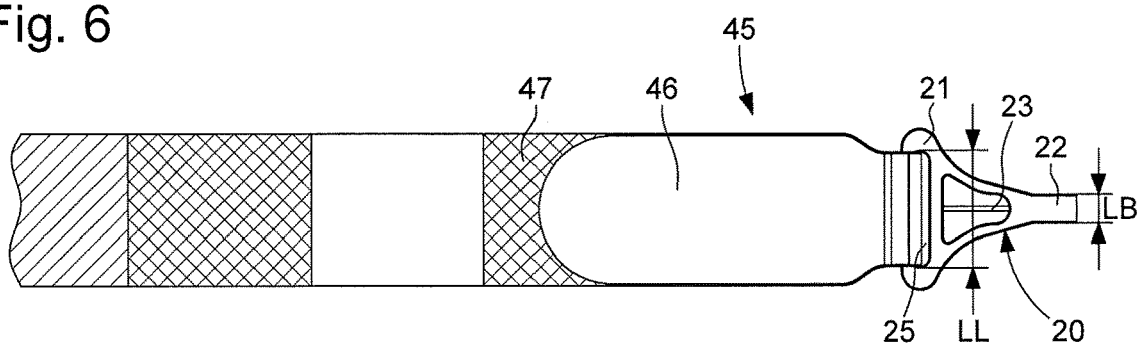
FIG. 6 shows a schematic, plan view of the bracelet strand comprised in the timepiece of FIG. 1 on the snap-hook side.
Figure 7:
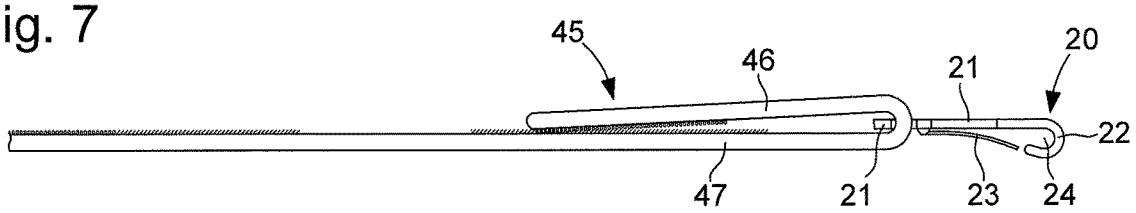
FIG. 7 is a view of the strand of FIG. 6, with its snap-hook including a hook carrying an elastic retaining latch and together defining an eyelet for housing the bar.
Figure 8:
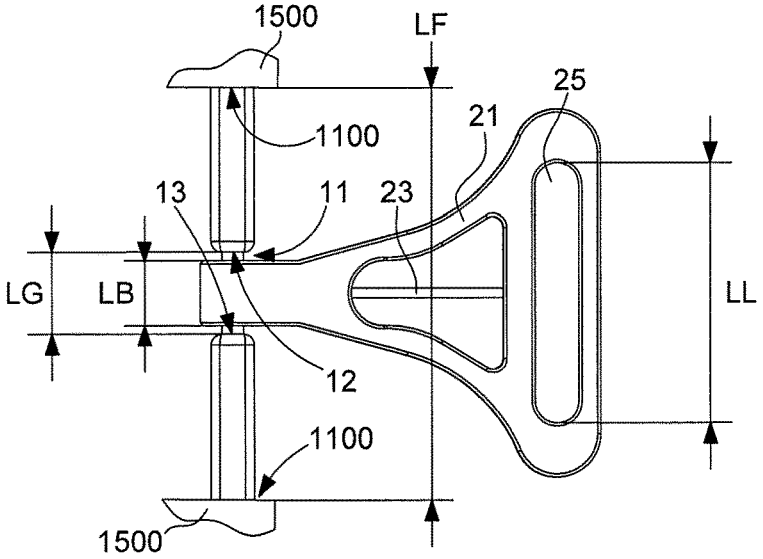
FIG. 8 represents a schematic, plan view of a detail showing the cooperation between a bar with a straight notch and the snap-hook.

In a particular variant, and as seen in FIG. 5, first strand 40 is arranged to be attached to a piece of clothing 500 of the user, by stitching 550, or a mechanical fastener 450, such as rivets, snap fasteners or otherwise.

More particularly hook 21 is stiffer than retaining latch 23. For example, hook 21 is made of metal, steel, precious alloy, titanium alloy or otherwise, and retaining latch 23 is made of spring steel or piano cord or carbon or otherwise.

More particularly, first strand 40 includes, at its first end 41, a first loop 45 which is arranged to be attached to hook 21 opposite curved beak portion 22. To this end, hook 21 includes, in particular, opposite curved beak portion 22, a housing 25, which is arranged to receive first loop 45 of first strand 40; more particularly, the width LL of housing 25, in the direction of extension of first bar 10, is more than triple the width LB of curved beak portion 22 in the longitudinal direction of first bar 10.

More particularly, first loop 45 defines a first upper strap piece 46 and a first lower strap piece 47 superposed on each other and arranged to be attached to each other by complementary securing means. In particular, the complementary securing means comprise Velcro for adjusting the length of bracelet 100 according to the morphology of its user or of his clothes, and for attaching first upper strap piece 46 and first lower strap piece 47 to each other. The Figures illustrate such an assembly, with chequered areas for the loops, and hatched areas for the hooks, or vice versa.

More particularly, as in the non-limiting variants illustrated by the Figures, structure 1000 includes a second slender bar 60, which is fixed or removable with respect to second points of attachment 1200 to a second set of horns 1600 of structure 1000, which second bar 60 is arranged to removably receive, either another karabiner-like snap-hook 20 fixed to a second end 42 comprised in first strand 40 or comprised in a second strand 50 arranged to be fixed to first strand 40, or a second loop 55 comprised in first strand 40, or comprised in a second strand 50 arranged to be fixed to first strand 40.

More particularly, second bar 60 is arranged to removably receive a second loop 55, which defines a second upper strap piece 56 and a second lower strap piece 57 superposed on each other and arranged to be attached to each other by complementary securing means. In particular, the complementary securing means comprise Velcro for adjusting the length of bracelet 100 according to the morphology of its user or of his clothes, and for attaching second upper strap piece 56 and second lower strap piece 57 to each other.

More particularly, the first set of horns 1500 is a first pair of horns arranged to receive first bar 10, and second set of horns 1600 is a second pair of horns arranged to receive second bar 60.

More particularly, just like first bar 10, second bar 60 includes, at a distance from each of the second points of attachment 1200, and over a length LG which is less than one third of the distance LF between the second points of attachment 1200, a notch 11 including two sides 12, 13 arranged to limit the lateral travel of curved beak portion 22, and to limit the angular travel of snap-hook 20 with respect to second bar 60, so as to prevent any contact between snap-hook 20 and the second set of horns 1600 to which second bar 60 is fixed.

Notch 11 of bar 10 or 60 can take various forms.

In the variants of FIGS. 1, 2, 5, 8, 10 and 12, notch 11 has two sides 12 and 13 which are substantially parallel, and the clearance between notch 11 and curved beak portion 22 is calculated to obtain operation without lateral friction in the thermal range of use, and is limited to a minimum value so as to force hook 21 to move substantially perpendicularly to the elongation of bar 10.

Figure 9:
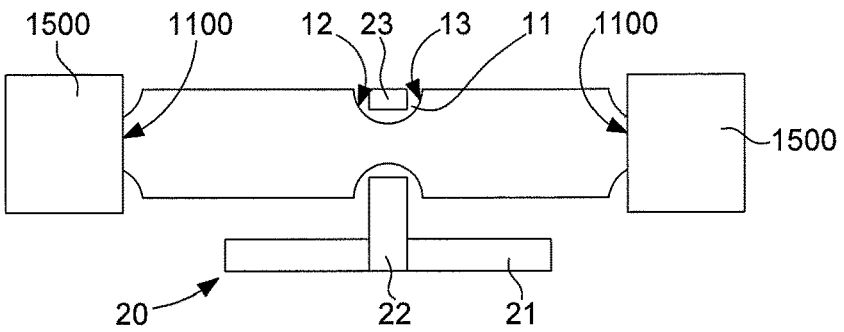
FIG. 9 represents a schematic view of a section between the horns of a timepiece or piece of jewellery according to the invention, with a bar that has a flared notch, and the curved beak portion of the snap-hook.
Figure 10:
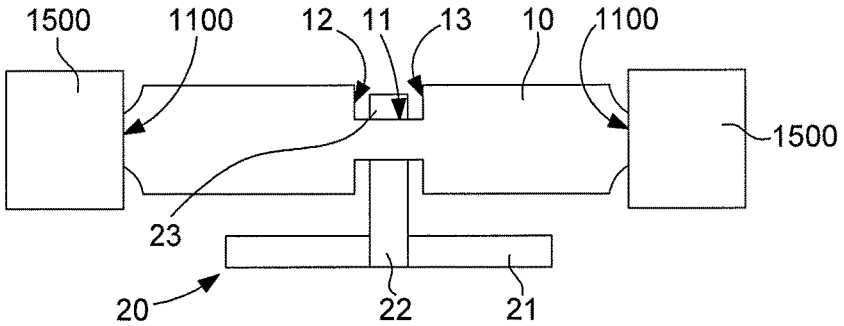
FIG. 10, which is similar to FIG. 9, illustrates a variant with a bar having a straight notch, and the curved beak portion of the snap-hook.

In the variant of FIGS. 9 (rounded) and 11 (V-shaped), notch 11 is flared with two non-parallel sides 12 and 13, and/or the clearance between notch 11 and curved beak portion 22 is calculated to obtain operation without lateral friction in the thermal range of use, and is arranged to allow oblique movements of hook 21 with respect to a plane perpendicular to the elongation of bar 10 in the contact area between curved beak portion 22 and first bar 10. The flexibility of use of a tilting arrangement makes it easy to wear timepiece or piece of jewellery 2000 over a non-cylindrical surface, for example on a frustum-shaped sleeve, and can withstand without damage any twisting caused by the user's movements.

Use over a wetsuit, racing suit, ski suit, hazmat suit or suchlike, is thus greatly facilitated. In a variant, first lower strap piece 47 and/or second lower strap piece 57 includes, on the side of the user or of his clothing, a lower friction coating, such as rubber, elastomer, textile, webbing or suchlike, to ensure that it remains in place.

More particularly, notch 11 has a length LG less than one third of distance LF between points of attachment 1100, 1200, of set of horns 1500, 1600, to which bar 10, 60 is fixed, and width LB of curved beak portion 22 in the direction of extension of bar 10, 60 is less than or equal to length LG of notch 11.

FIG. 11 illustrates a tilting position of snap-hook 20 with respect to a bar 10, at a tilt angle $\alpha$, curved beak portion 22 of snap-hook 20 is represented in an extreme warped position, limited by the cooperation between curved beak portion 22 and notch 11 of bar 10, in which there is a first non-zero safety distance SA between horns 1500 and snap-hook 20.

FIG. 12 illustrates a position of flat rotation of snap-hook 20 in the plane of horns 1500 at an angle of rotation 13, curved beak portion 22 of snap-hook 20 is in a position of extreme displacement in the plane of the horns, limited by the cooperation between curved beak portion 22 and notch 11 of bar 10, and in which exists a second safety distance SB between the horns and the snap-hook.

Thus, the user is assured of never damaging either horns 1500, 1600, or structure 1000 which carries said horns, with snap-hook 20 or the end of the bracelet.

The combination of using of an easy length adjustment, particularly through the use of Velcro, on one of the pairs of horns, having a length adjustment that can be large and ensures user comfort, with a safety snap-hook on the other pair of horns, guarantees easy use, even in extreme conditions, for example when a timepiece is worn over a special suit of very large volume, by ensuring not just against loss of the timepiece but also against damage thereto.

In a variant, the timepiece or piece of jewellery 2000 is a watch.

In another variant, the timepiece or piece of jewellery 2000 is a jewel.

The invention claimed is:

1. A timepiece or piece of jewelry comprising:

a structure which includes at least one set of horns, and at least a first slender bar, which is fixed or removable with respect to first points of attachment to a first set of horns, the first slender bar is arranged to removably receive a snap-hook fixed to a first end of a first strand of said timepiece or piece of jewelry, said snap-hook comprising, a hook including a curved beak portion arranged to enclose said first slender bar on part of its circumference, and a retaining latch which is elastic or elastically fixed to said hook and is configured to close an eyelet opening of the snap-hook, and arranged to allow insertion of said first slender bar into said eyelet opening of said snap-hook by pressure in a plane substantially perpendicular to an axis of said first slender bar, and to prevent removal thereof from said snap-hook without user manipulation, wherein said first slender bar includes, at a distance from each of said first points of attachment to said structure, a notch having two sides arranged to limit lateral travel of said curved beak portion, and to limit angular travel of said snap-hook with respect to said first slender bar, in order to prevent any contact between said snap-hook and said first set of horns to which said first slender bar is fixed.

2. The timepiece or piece of jewelry according to claim 1, wherein said first strand is a strand of a bracelet of said timepiece or piece of jewelry.

3. The timepiece or piece of jewelry according to claim 1, said first strand is arranged to be attached to a piece of clothing.

4. The timepiece or piece of jewelry according to claim 1, wherein said hook is stiffer than said retaining latch.

5. The timepiece or piece of jewelry according to claim 1, wherein said first strand includes, at said first end thereof, a first loop arranged to be attached to a portion of said hook opposite said curved beak portion.

6. The timepiece or piece of jewelry according to claim 5, wherein said hook includes, opposite said curved beak portion, a housing arranged to receive said first loop of said first strand, and a width LL of said housing, in a direction of extension of said first slender bar, is more than triple a width LB of said curved beak portion in the longitudinal direction of said first slender bar.

7. The timepiece or piece of jewelry according to claim 6, wherein said first loop defines a first upper strap piece and a first lower strap piece superposed on each other and arranged to be attached to each other by complementary securing means.

8. The timepiece or piece of jewelry according to claim 7, wherein said complementary securing means include a hook and loop fastener for adjusting a length of a bracelet including said first upper strap piece and said first lower strap piece, and for attaching to one another said first upper piece and said first lower piece.

9. The timepiece or piece of jewelry according to claim 1, wherein said structure includes a second slender bar, which is fixed or removable with respect to second points of attachment to a second set of horns comprised in said structure, said second bar is arranged to removably receive either another said snap-hook fixed to a second end comprised in said first strand or comprised in a second strand arranged to be attached to said first strand, or a second loop comprised in said first strand, or comprised in a second strand arranged to be attached to said first strand.

10. The timepiece or piece of jewelry according to claim 9, wherein said second bar is arranged to removably receive a said second loop, which defines a second upper strap piece and a second lower strap piece which are superposed on each other and arranged to be attached to each other by complementary securing means.

11. The timepiece or piece of jewelry according to claim 10, wherein said complementary securing means include a hook and loop fastener for adjusting a length setting of a bracelet including said first upper strap piece and said first lower strap piece, and for attaching to one another said first upper strap piece and said first lower strap piece.

12. The timepiece or piece of jewelry according to claim 9, wherein said first set of horns is a first pair of horns arranged to receive said first slender bar, and said second set of horns is a second pair of horns arranged to receive said second bar.

13. The timepiece or piece of jewelry according to claim 9, wherein said second bar includes, at a distance from each of said second points of attachment and over a length LG which is less than one third of a distance LF between said second points of attachment, a notch including two sides arranged to limit the lateral travel of said curved beak portion, and to limit the angular travel of said snap-hook with respect to said second bar, so as to prevent any contact between said snap-hook and said second set of horns to which said second bar is fixed.

14. The timepiece or piece of jewelry according to claim 1, wherein said notch has two sides which are substantially parallel, and a clearance between said notch and said curved beak portion is calculated to obtain operation without lateral friction in a thermal range of use, and is limited to a minimum value so as to force said hook to move substantially perpendicularly to an elongation of said first slender bar.

15. The timepiece or piece of jewelry according to claim 1, wherein a clearance between said notch and said curved beak portion is calculated to obtain operation without lateral friction in a thermal range of use, and the clearance is arranged to allow oblique movements of said hook with respect to a plane perpendicular to an elongation of said first slender bar in a contact area between said curved beak portion and said first slender bar.

16. The timepiece or piece of jewelry according to claim 1, wherein said notch has a length LG less than one third of a distance LF between the points of attachment of the first set of horns to which said first slender bar is fixed, and a width LB of said curved beak portion in a direction of extension of said first slender bar is less than or equal to said length LG of said notch.

17. The timepiece or piece of jewelry according to claim 1, wherein said timepiece or piece of jewelry is a watch.

18. The timepiece or piece of jewelry according to claim 1, wherein said snap-hook is made of a titanium alloy.

19. The timepiece or piece of jewelry according to claim 1, wherein said notch is flared with two non-parallel sides.

* * * * *